US006300616B1

(12) United States Patent
Regensburger

(10) Patent No.: US 6,300,616 B1
(45) Date of Patent: Oct. 9, 2001

(54) DETECTOR CIRCUIT WITH A STATIONARY POTENTIAL AMPLIFIER INPUT

(75) Inventor: Martin Regensburger, Neumarkt (DE)

(73) Assignee: Diehl Stiftung & Co. (DE)

( * ) Notice: Subject to any disclaimer, the term of this patent is extended or adjusted under 35 U.S.C. 154(b) by 0 days.

(21) Appl. No.: 09/438,634

(22) Filed: Nov. 12, 1999

(30) Foreign Application Priority Data

Dec. 22, 1998 (DE) ..... 198 59 394

(51) Int. Cl.[7] ..... H01J 40/14
(52) U.S. Cl. ..... 250/214 LA; 250/214 R
(58) Field of Search ..... 250/214 R, 214 A, 250/214 LA, 214 C; 330/59, 308

(56) References Cited

U.S. PATENT DOCUMENTS 4,056,061 11/1977 Becklund .
4,939,476 * 7/1990 Crawford ..... 330/59
5,049,752 9/1991 Kalaf et al. .

FOREIGN PATENT DOCUMENTS 26 34 595 A1 3/1977 (DE) .
24 56 162 A1 2/1981 (DE) .
32 10 207 C1 10/1991 (DE) .
34 10 942 C1 4/1992 (DE) .
0 315 855 A1 10/1988 (EP) .

* cited by examiner

*Primary Examiner*—Que T. Le
(74) *Attorney, Agent, or Firm*—Scully, Scott, Murphy & Presser

(57) ABSTRACT

The detector circuit (11) of a radiation-sensitive sensor (10) with capacitive high pass coupling (14) between a pre-amplifier (13) and a signal amplifier (15) is blocked for a prolonged period of time (T2) even after termination of an overexcitation effect, because of the high filter time constant of the series capacitor (25), because the capacitor (25) only slowly experiences charge reversal and therefore the signal amplifier (15) following it initially still remains overdriven until the capacitor (25) has reversed charge again to a dc voltage level in the actuation range (39) of the signal amplifier (15). That dead time period (T2) is however curtailed to a short fraction (T1) if upon termination of overexcitation at the input side the capacitor (25) at the output side, that is to say upstream of the signal amplifier (15), is forcibly returned to the—virtual—ground potential at the amplifier input, for potential reduction purposes, by way of a low-resistance switching section (31). Such charge reversal can also be triggered under software control if no useful signals (17) which can be utilised have occurred over a relatively long period of time because for example permanently high actuation of the sensor (10) has resulted in an excessive potential displacement at the coupling capacitor (25).

6 Claims, 2 Drawing Sheets

DETECTOR CIRCUIT WITH A STATIONARY POTENTIAL AMPLIFIER INPUT

BACKGROUND OF THE INVENTION

1. Field of the Invention

The invention concerns a detector circuit which includes a radiation-sensitive sensor and downstream-connected filter and simplifier stages for outputting a useful signal.

2. Description of the Prior Art

A detector circuit of that kind is known from DE 24 56 162 A1 in the form of a band pass filter which is operated by way of a pre-amplifier from an optronic detector element which is disposed as an optronic sensor in a radiation-sensitive voltage divider.

In accordance with EP 0 315 855 A1 a respective amplifier is actuated from the central tapping of a radiation-sensitive voltage divider so that, when a plurality of detector elements are provided, the number of passage means for passing through a housing can be reduced by single-pole interconnection within the housing. In that arrangement the detector elements involve sensors which are responsive to thermal radiation.

The detector circuit of the general kind set forth is intended to make available a useful signal for further processing in an evaluation circuit, which preferably involves a firing triggering circuit in accordance with German patent specification No 34 109 42 or also German patent specification No 32 102 07, with inter alia a radiation-sensitive voltage divider.

Functioning of the radiation-sensitive voltage divider is based on the consideration that the steady signal level occurring at the central tapping fluctuates in dependence on the irradiation of the detector element and generally falls by virtue of a greater degree of conductivity in relation to more intensive irradiation. This excitation-dependent drop in level which is superimposed on a steady or dc voltage level is identified here as the detector signal which is converted by means of the detector circuit into the useful signal to be outputted.

A particular disadvantage with the detector circuit of the general kind set forth is that the filter stage with its high-pass characteristic for separation of the fluctuating detector signal from the steady signal level involves the occurrence of capacitive charge reversal phenomena which are troublesome, as they last for a long time, in particular when the aim is to achieve a high pass edge or corner frequency which is as low as possible, as for example when using that detector circuit in a seeking fuse sensor for target acquisition purposes. If therefore for example strong but only momentary excitation of the detector element is implemented by the received radiation (as in the case of a flash of light in relation to an optronic detector element or when the situation involves pivoting over a locally limited heat from a fire with a thermal detector element), then that, in the series capacitance of the high pass filter, results in the displacement of a very large quantity of charge. That potential displacement must be reversed again as quickly as possible when the extreme radiation excitation is terminated so that the detector circuit again then furnishes a useful signal which follows the normal intensity of radiation sources which are really of interest. The high charge reversal time constant as a result of low high pass edge frequency however means that strong charging of the series capacitance only reverts with a delay to the rate of the reduced excitation; while a reduced excitation following the strong excitation, because of the high charge reversal time constant of the series capacitance and overdriving of long duration, resulting therefrom, of the following signal amplifier is initially not evaluated at all until the charging of the coupling capacitor has fallen again with the long time constant to the potential of the sensor-governed potential fluctuations.

There is therefore also the disadvantage that the signal amplifier which is connected on the output side of the high pass filter is immediately overdriven by a high displacement current and is then initially still held in the overdriven mode until the charge reversal phenomena have sufficiently died away again in accordance with the given time constant. As a result the signal amplifier only returns to its linear working range again, for the output of a useful signal which can be utilised, when the extreme detector excitation has long ago decayed; with the consequence that, during a certain period of time, even after decay of the extreme excitation, the normal ambient factors which are detected by sensor means still cannot be processed again. That problem becomes all the more serious in a practical context as the steady signal level, which is relatively high due to the equalisation action involved, at the central tapping of the radiation-sensitive voltage divider does not allow a high level of pre-amplification upstream of the high pass device. because otherwise synchronisation errors in sensors operating in parallel would be excessively amplified; while on the other hand pre-amplification would be something to strive for, in the interests of an improvement in the signal-noise ratio in the useful signal.

SUMMARY OF THE INVENTION

In consideration of those aspects the object of the present invention is to develop a detector circuit of the general kind set forth, at the lowest possible level of expenditure in terms of components, in such a way that in the detector circuit a recovery time caused by the high pass action—more specifically after only temporarily extreme excitation of at least one of its detector elements—is curtailed as much as possible in order to have the normal mode of operation available again as soon as possible after decay of the overexcitation effect.

In accordance with the invention, that object is attained in that the detector circuit of the general kind set forth is designed with a switching section connected intermediate a series capacitor of the filter circuit and an input of the signal amplifier, and the switching section returns the potential at the amplifier input to a stationary condition.

By virtue of that configuration, overshooting of the detector signal in opposite directions upon abrupt termination of the overexcitation effect is detected by a trigger circuit in order to close a switching section which branches off between the series capacitance and a signal amplifier following same, and in addition with a short time constant to pass the potential at the capacitor from saturation back to below the overdriving limit of the downstream-disposed signal amplifier. In that way the signal amplifier can then be operated again in accordance with the current fluctuation in the detector signal and thus supply a suitably amplified useful signal. The dead time after decay of the excitation effect is thus less by a multiple (of the order of a thousand times) than when the drop in the capacitor charge and thus the input level of the signal amplifier would have to be expected in accordance with the exponential function with the very high time constant which is predetermined for the desired low edge frequency.

Because therefore the detector circuit of a radiation-sensitive sensor with capacitive high pass coupling between the pre-amplifier and the signal-amplifier, because of the high filter time constant of the series capacitor, is also still blocked after termination of overexcitation for a prolonged period of time while the capacitor is still experiencing charge reversal and the signal amplifier following it therefore still remains overdriven until the potential at the capacitor has again assumed a sufficiently low value, in accordance with the invention that dead time period is curtailed to a small fraction by a procedure whereby, with decay of the input-side overexcitation the capacitor upstream of the signal amplifier is quickly forcibly discharged by way of a low-resistance switching section until the potential corresponding to the steady component tapped off by the voltage divider is restored. This potential which is forced by way of the switching section is in practice the virtual ground potential at the input of the operational amplifier connected on the output side of the high pass filter. In that respect the charge reversal procedure at the coupling capacitor represents compelled rapid return of the capacitor charge to the initial potential which is predetermined by the amplified steady component from the sensor. Such forced charge reversal can also be initiated under software control, besides by way of the trigger circuit, and that is particularly advantageous if no useful signals which can be utilised have occurred over a relatively long period of time because possibly permanently high actuation of the sensor has resulted in overcharging of the coupling capacitor.

BRIEF DESCRIPTION OF THE DRAWINGS

Additional alternatives and developments as well as further features and advantages of the invention will be apparent—having regard also to the disclosure in the accompanying Abstract—from the example hereinafter of a preferred embodiment of the configuration according to the invention, which is shown in somewhat diagrammatic form in terms of circuitry configuration in the drawing, being limited to what is essential. In the drawing.

DETAILED DESCRIPTION OF PREFERRED EMBODIMENTS

Figure 1:
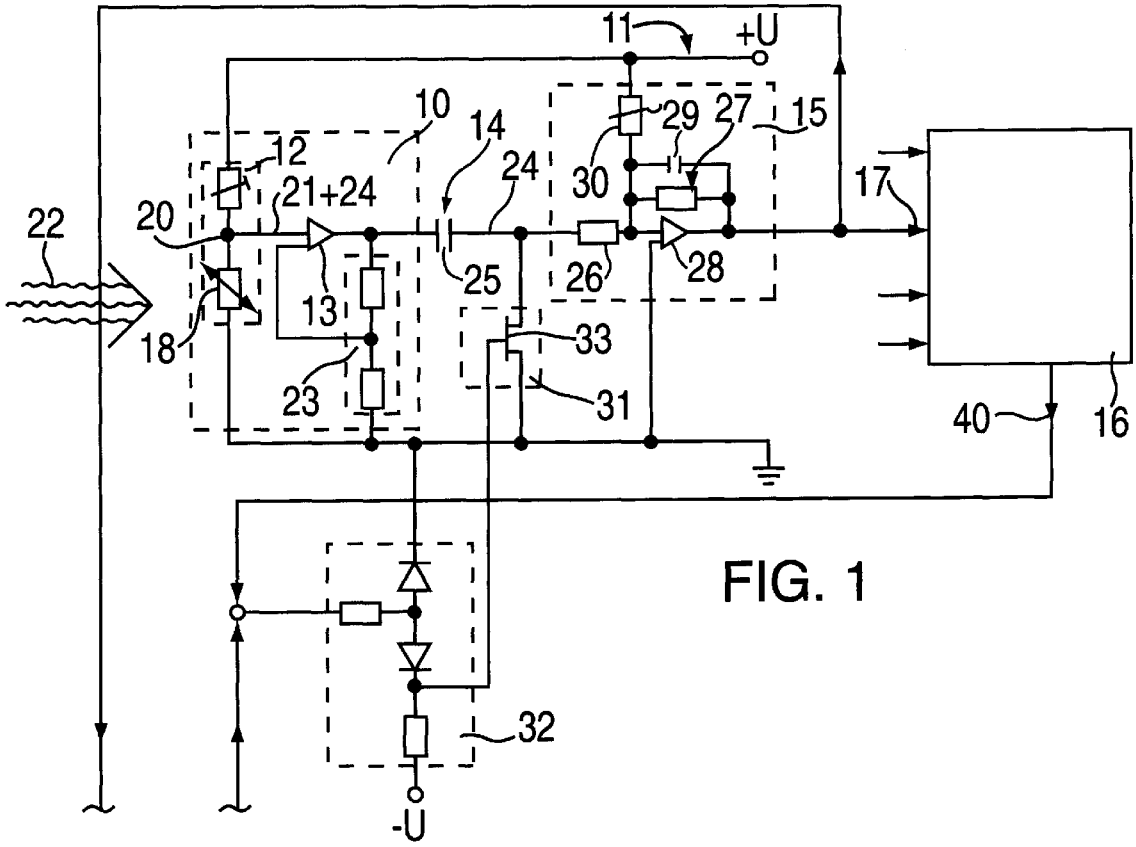
FIG. 1 shows an overdriving-sensitive detector circuit with capacitive high pass filter upstream of its signal amplifier.
Figure 2:
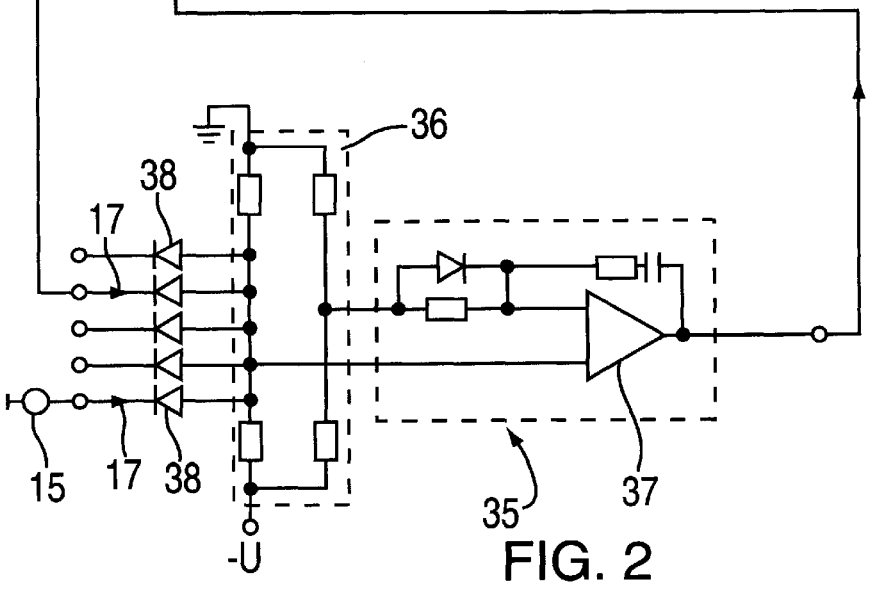
FIG. 2 shows a trigger circuit for rapid forced return of the circuit shown in FIG. 1 from overdriving.

The sensor 10 of the detector circuit 11 shown in FIG. 1 substantially comprises a radiation-sensitive voltage divider 12 at the input side, with the physical detector element 18 and a sensitive pre-amplifier 13 connected on the output side thereof. Connected on the output side of the sensor 10, by way of a high pass 14 as a dc voltage barrier, for alternating signal amplification, is an operational amplifier 15 whose output useful signal 17 which is thus obtained from the fluctuations in the detector signal 24 operates an evaluation circuit 16.

The radiation-sensitive voltage divider 12 substantially comprises the series circuit of the detector element 18 and a trimming resistor 19. The latter serves for synchronisation setting when a plurality of sensors 10 or detector circuits 11 are operated in parallel (see also German patent specification No 34 109 42) in order to operate the evaluation circuit 16 in a multi-channel mode.

Depending on the respective operating characteristic of the detector element 19 which is actually used, the central tapping 20 of the radiation-sensitive voltage divider 12, when the detector element 18 is not irradiated, supplies a more or less high rest steady signal level 21 of the typical order of magnitude of between 10 mV and 300 mV. That signal level 21 changes when the detector element 18 for example becomes of lower resistance as a result of being irradiated as indicated at 22, which means that it supplies a detector signal 24. That fluctuation 24 which is superimposed on the steady signal level 21 and which is to be converted to the signal 17 at the output of the detector circuit 11 is of the order of magnitude of typically only about 1 mV.

In the interests of having a good useful/noise signal ratio for the sensor 10, in the circuitry structure involved the pre-amplifier 13 follows as closely as possible behind the detector element 18 and thus practically directly at the voltage divider central tapping 20. The pre-amplifier 13 involves an operational amplifier which is operated in a non-inverting mode, with purely ohmic proportional circuitry 23 for a comparatively low gain factor of the order of magnitude of only about 'ten' so that no overdriving occurs in spite of the steady signal level 21 which is high at the input side in relation to the detector signal 24.

Actual useful amplification to afford the output signal 17 of the detector circuit 11 is only effected in the signal amplifier 15 which is operated in the inverting mode, after the detector signal 24 which fluctuates in dependence on radiation has been separated from the steady signal level 21 by means of the high pass 14 serving as a direct current barrier.

The high pass 14 can simply comprise a series circuit consisting of a series capacitor 25 and a resistor 26 which can be the series resistor in the signal amplifier 15. The product of the magnitudes C×R thereof determines the charge reversal time constant of the capacitor 25 and thus the lower or edge frequency in the filter action of the high pass 14. For practical implementation of such a detector circuit 11, the endeavour is to have an edge frequency which is as low as possible, for example of the order of magnitude of 10 Hz, having regard to the dynamics of the radiation fluctuation. That governs the design configuration of the capacitor 25 with a comparatively very high capacitance in order to achieve the time constant for such a low edge frequency with a sufficiently small series resistor 26 as, with the size of the resistance value, the dynamic noise power which is superimposed on the useful signal 17 as a troublesome factor would rise, in the useful signal 17.

The operational amplifier 28, operated in the inverting mode, of the signal amplifier 15 has a proportional circuitry 27 for the ac voltage feed in relation to the series resistor 26; the circuitry 27 is designed for maximum possible amplification (of the order of magnitude of 200) in order to be able to feed the evaluation circuit 16 with a useful signal 17 of strong amplitude. An additional capacitive feedback 29 provides for frequency limitation in an upward direction for the amplification effect, as a result of its short-circuit at high frequencies. The working point of amplifier operation is set by a variable resistor 30 which is connected to the supply voltage +U.

If, as a result of temporarily very strong irradiation 22, at least one of the detector elements 18 of the detector circuits which operate in parallel on the evaluation unit 16 is extremely strongly excited, the detector signal 24 performs a correspondingly steep deflection (see FIG. 3) relative to the steady signal level 21. That is followed by a correspondingly steep and severe overshoot in the opposite direction of the detector signal 24 at the abrupt end of the intensive irradiation effect.

That gives rise in the capacitor 25 to respective charge reversal processes which emanate from high charge peaks, this meaning restoration to the voltage value which corresponds to the direct component supplied by the voltage divider 12. The consequence of such a charge reversal procedure, which lasts for a long period of time, is that the useful signal 17 from the signal amplifier 15 can again follow a radiation excitation which in the meantime has already died away again, only when the charge reversal in the capacitor 25 has decayed below the overdriving limit of the amplifier 15. That results in a dead period which is much too long and which lasts beyond the decay of the extreme excitation. It would admittedly be possible to envisage limiting the amplitude of the overshoot by means of a negative feedback effect which is expensive and complicated in terms of circuitry engineering and critical in regard to operational technology; but the desirable rapid restoration of the response capability on the part of the sensor 10 would still not be achieved thereby because in that case the high pass 14 would only remain over-saturated at a reduced amplitude until its capacitor 25 has again experienced charge reversal in accordance with the circuit time constant.

In accordance with the present invention therefore that charge reversal and therewith in practice re-enablement of the function of the sensor 10 is forced thereby immediately upon decay of the extreme excitation at the detector, by virtue of the fact that the capacitor 25 upstream of the signal amplifier circuit 15 is connected directly to ground potential by way of a comparatively low-resistance switching section 31, and thus with a short time constant. The switching section 31 can also bridge over the series resistor 26; for the crucial thing is that as soon as possible after overexcitation stable conditions prevail again, which are characterised in that the virtual ground potential of the input of the amplifier 28 prevails in the absence of a flow of current by way of the series resistor 26 downstream of the series capacitor 25. Because however bridging over the series resistor 26 would only switch through the virtual ground potential, the switching section 31 operates towards the circuit ground (as shown) more reliably as it is more stable.

If the switching section 31 is an electronic switch for example of a field effect transistor kind, then a biasing circuit 32 of the illustrated kind ensures by means of a diode voltage drop that at the actuated gate of the field effect transistor 33 the necessary potential, obtains for the ground potential also to go to the output side of the capacitor 25 when the section is in the conducting condition. The diversion section resistance of the order of magnitude of typically only about 7 Ω, even in the event of a very high capacitance in respect of the series capacitor 25, affords a sufficient short charge reversal time constant of typically less than 30 $\mu$s, in comparison with an order of magnitude of 30 ms in the case of charge reversal by way of the higher resistor 26.

For that compelled return of the potential at the series capacitor 25 to the stable condition thereof immediately upon termination of overexcitation the field effect transistor 33 is caused to conduct by way of the biasing circuit 32 by a voltage-controlled trigger circuit 35 which includes a resistor bridge circuit 36 comprising two parallel-connected voltage dividers for the two input thresholds. The comparator 37 which in that way is connected across the diagonals thereof has capacitive positive feedback for the time characteristic in terms of response and a diode parallel to the series resistor for asymmetry of the response characteristic. The trigger circuit 35 responds when at least one of the detector circuits 11 which are operated in parallel relationship is overdriven and thereby a maximum useful signal reverses the comparator 37 by way of a diode OR-circuit 38.

Current overdriving of the sensor 10 for example due to a momentarily particularly intensive irradiation effect 22 thus results, with its abrupt termination, in the section 31 switching through. As a result the capacitor 25 experiences rapid charge reversal and thus the input level at the signal amplifier 15 is rapidly returned into the range within the overdriving limits.

Figure 3:
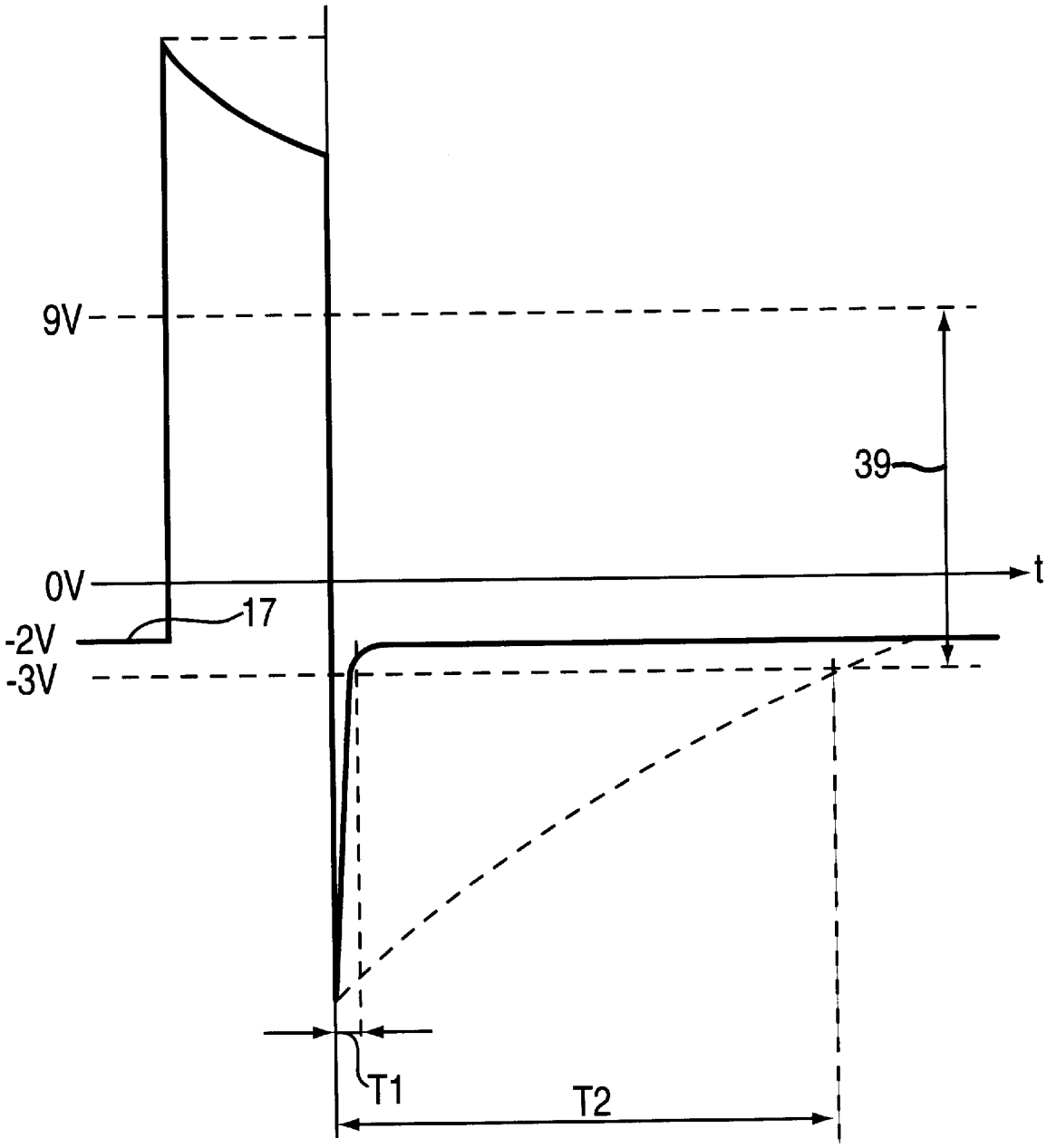
FIG. 3 shows a voltage-time diagram to show the behaviour in principle of the detector circuit of FIG. 1 without and with the action of the trigger circuit shown in FIG. 2.

These conditions are shown symbolically in FIG. 3 (not entirely on the correct time scale). When the irradiation effect 22 from a particularly intensive source is detected the useful signal 17 rises from its working point potential which typically is at just −2 volts steeply to an upper limit far above the upper working range of about 9 volts and decays from there in accordance with the high pass time constant 14. The abrupt end to the intensive irradiation effect results in overshooting by the residual potential to reversed polarity at the output of the series capacitor 25 in order thereafter to be determined in its characteristic in respect of time by the high time constant of charge reversal of the capacitor 25. That results in a long dead or barren time T2 until the charge at the capacitor 25, that is to say the dc potential again exceeds the lower one of the limits of the actuation range 39 for the signal amplifier 15 which are shown in broken horizontal line in FIG. 3. The dead time T2 is however reduced to a fraction T1 if immediately upon termination of the overexcitation effect the potential downstream of the capacitor 25 is returned towards ground (0 volt) and in that case goes above the lower range limit back into the stable working potential of just −2 volts.

In accordance with the present invention however return of the potential at the capacitor 25 does not have to be initialised by the trigger circuit 35. For, even without clearly momentary overdriving, a longer severe irradiation action on the sensor 10 can result in vigorous charging of the capacitor 25, with the consequence that the signal amplifier 15 is overdriven for a prolonged period of time and therefore does not deliver a useful signal 17. If prolonged failure of any useful signal 17 to appear is detected in the evaluation circuit 16, that is to say so-to-speak in software terms, it is desirable for example for a discharge signal 40 to be outputted from the evaluation circuit 16. for charge reversal of the capacitor 25, by way of the low-resistance section 31. That ensures that the input level of the signal amplifier 15 is again within the actuation range 39 and the absence of useful signals 17 is therefore not to be attributed to a charge blockade of the separating capacitor 25.

What is claimed is:

1. A detector circuit (11) including a radiation-sensitive sensor (10), a signal amplifier (15) being connected downstream of said sensor across an interposed high pass-filter circuit, characterized in that a switching section (31) is connected intermediate a series capacitor (25) of said filter circuit and an input of said signal amplifier (15), whereby through said switching section the potential at the amplifier input is returnable to a stationary condition following an overloading of the amplifier (15) which corresponds to the input potential present prior to activation of the sensor (10).

2. A detector circuit according to claim 1 characterised in that the switching section (31) is actuable by way of a trigger circuit (35) which is acted upon by the output of the detector circuit (11).

3. A detector circuit according to claim 1 characterised in that the switching section (31) is actuable from an evaluation circuit (16) for the useful signal (17) when a useful signal (17) fails to appear over at least one predetermined period of time.

4. A detector circuit according to claim 1 characterised in that the switching section (31) is actuable by way of a trigger circuit (35) with a bridge circuit (36), across the diagonal of which is disposed a comparator (37) and which can be unbalanced by at least one of a plurality of detector circuits (11) operating in parallel.

5. A detector circuit according to claim 1 characterised in that the switching section (31) is embodied by a controllable semiconductor component which is actuable by way of a biasing circuit (32) for low-ohmic forward resistance.

6. A detector circuit according to claim 1 characterised in that the switching section (31) is a field effect transistor.

* * * * *